US007566811B2

(12) United States Patent
Louret et al.

(10) Patent No.: US 7,566,811 B2
(45) Date of Patent: Jul. 28, 2009

(54) MOVING BED PROCESS FOR PRODUCING PROPYLENE, RECYCLING A FRACTION OF USED CATALYST

(75) Inventors: Sylvain Louret, Lyons (FR); Vincent Coupard, Vaulx En Velin (FR); Patrice Font, Mornant (FR); Eric Sanchez, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 510 days.

(21) Appl. No.: 11/226,349

(22) Filed: Sep. 15, 2005

(65) Prior Publication Data

US 2006/0063957 A1 Mar. 23, 2006

(30) Foreign Application Priority Data

Sep. 15, 2004 (FR) ..... 04 09795

(51) Int. Cl.
*C07C 4/02* (2006.01)

(52) U.S. Cl. ..... 585/653; 585/648; 208/106; 208/113

(58) Field of Classification Search ..... 585/648, 585/653; 208/113
See application file for complete search history.

(56) References Cited

U.S. PATENT DOCUMENTS

| | | | | |
|---|---|---|---|---|
| 6,884,400 | B1 | 4/2005 | Austin et al. | |
| 7,087,155 | B1 | 8/2006 | Dath et al. | |
| 7,371,911 | B2 | 5/2008 | Butler et al. | |
| 7,375,257 | B2 | 5/2008 | Dath et al. | |
| 2003/0223918 | A1 * | 12/2003 | Cammy et al. | 422/144 |
| 2005/0096492 | A1 * | 5/2005 | Dath et al. | 585/653 |
| 2006/0100473 | A1 | 5/2006 | Grootjans et al. | |

* cited by examiner

*Primary Examiner*—In Suk Bullock
(74) *Attorney, Agent, or Firm*—Millen, White, Zelano & Branigan, P.C.

(57) ABSTRACT

A process for producing propylene from a steam cracking and/or catalytic cracking light olefinic cut, involves a moving bed catalytic cracking step with a catalyst regeneration loop. The process recycles a portion of the used catalyst to the inlet of the moving bed reactor. Nevertheless, the conversion is high, with a good yield and good propylene selectivity.

20 Claims, 2 Drawing Sheets

MOVING BED PROCESS FOR PRODUCING PROPYLENE, RECYCLING A FRACTION OF USED CATALYST

FIELD OF THE INVENTION

The invention relates to a process for at least partially converting a hydrocarbon feed comprising olefins in the C2 to C12 range, for example a C4 and/or C5 cut from steam cracking or FCC into propylene. The term FCC (fluid catalytic cracking) means catalytic cracking in a fluidized bed and the term Cn designates a cut of hydrocarbons essentially containing n carbon atoms.

Olefinic C4/C5 cuts are available in large quantities, often in excess, in oil refineries and in steam cracking facilities.

However, recycling to the steam cracking step has disadvantages as the light olefin yields are lower than with paraffinic cuts, and their tendency to form coke is relatively higher.

Furthermore, recycling them to a conventional FCC unit is not possible as they are very unreactive under conventional FCC conditions, which are adapted to vacuum distillate type feeds.

The feed for the process of the invention is typically a light olefinic feed primarily containing 4 to 12 carbon atoms for which conventional recycling is difficult.

The process for converting a light olefinic feed into a cut comprising propylene described in the present invention employs catalytic reactions that can directly convert said light olefins into propylene, i.e. without a preliminary independent olefin oligomerization step. That type of process is termed one-step oligocracking as opposed to the two-step process in which a first oligomerization step is followed by a step for cracking the effluents from oligomerization carried out using a catalyst and operating under conditions which are distinct from those used in the first oligomerization step.

In the remainder of the text, the process of the invention will be designated a one-step oligocracking process, or occasionally simply an oligocracking process, it being understood that it is carried out in a single step.

The catalysts used in this type of reaction are generally zeolitic catalysts with an Si/Al ratio in the range 50 to 1200, preferably in the range 60 to 800, and more preferably in the range 75 to 140 selected from two groups, MFI and MEL. The Si/Al ratio under consideration is that of the zeolitic part of the catalyst alone.

The process of the present invention is characterized by using the catalyst in a moving bed with very precise control of the mean catalyst activity in the reactor by recycling a portion of the used catalyst removed from the reactor outlet.

PRIOR ART

European patent application EP-A1-1 195 424 describes a process using a zeolitic MFI type catalyst having a Si/Al ratio of 180 to 1000 or a zeolitic MEL type catalyst having a Si/Al ratio of 150 to 800, said high Si/Al ratios being employed to limit hydrogen transfer reactions responsible for the production of dienes, aromatics and for olefin saturation (propylene). The temperature is in the range 500° C. to 600° C., the partial pressure of the olefins is in the range 0.01 MPa to 0.2 MPa (1 MPa=$10^6$ Pa), and the space velocity is in the range 5 $h^{-1}$ to 30 $h^{-1}$.

That process is used in moving bed mode, the catalyst being removed intermittently then regenerated and recycled.

According to that invention, a "moving bed" designates a bed of particles which are generally substantially spherical, with a characteristic dimension in the range 0.5 to 5 mm, employed in a reactor in which the particles are packed and thus where each particle is in substantially permanent contact with other contiguous particles. In contrast to a fluidized bed in which the particles, generally with a dimension of less than 0.2 mm, are in permanent motion and where the particle distribution in the bed mixes and renews rapidly, the moving bed moves very slowly, by intermittent sequential or continuous removal of a portion of the used catalyst particles from the lower portion of the bed. The mean flow rate of particles in a moving bed (integrating the periods in which there is no flow) is very low, generally much less than 0.1 m per minute.

U.S. Pat. No. 6,284,939 B1 describes a moving bed configuration in which a fraction of the catalyst is withdrawn from the reaction zone and is then stripped during its transport to a regeneration zone. The catalyst is then regenerated and sent to the head of the reaction section;

US-A-2003/0223 9918 describes recycling a fraction of the used catalyst to the head of the reaction zone to a fluidized bed catalytic cracking process.

The fraction of the recycled, non regenerated catalyst is introduced as a mixture with the regenerated catalyst fraction. The non regenerated catalyst recycle flow rate is automatically controlled from measurements of the flow rates of the used catalyst, the regenerated catalyst and the recycled catalyst.

The recycling of the used catalyst described in that patent exclusively concerns a fluidized bed FCC unit and not a unit functioning in moving bed mode as is the case in the present invention, as will be explained below.

BRIEF DESCRIPTION OF THE INVENTION

The Applicant has surprisingly discovered that using a moving bed in oligocracking produces disappointing results compared with catalytic tests in a fixed bed. The Applicant then discovered that this could be explained in the case of oligocracking by the gradient of catalytic activity within a moving bed: the catalyst in the upper portion of the bed is regenerated catalyst, which is highly active, while the catalyst in the lower portion of the reactor is considerably used. The reactions in the lower and upper part of the moving bed have thus not advanced to the same point, in particular hydrogen transfer reactions, which reduces the mean overall yield, as it is impossible to have a single optimum catalytic activity.

In accordance with the invention, it has been discovered that recycling a portion of the used catalyst to the head of the moving bed, mixed with regenerated catalyst, can reduce the mean overall catalytic activity and it can adapt itself to the optimum value. Further, this activity reduction effect is relatively more marked at the head of the reactor than at the bottom as the rate of circulation of the moving bed can be adjusted to alter the activity of the used catalyst. The invention can thus reduce the catalytic activity gradient between the head and foot of the reactor. This effect is beneficial as large disparities in catalytic activity inevitably result in loss of yield, due to poor progress of the reaction.

In summary, the invention may be defined as a process for catalytic oligocracking of a light olefinic hydrocarbon feed comprising hydrocarbons containing 2 to 12 carbon atoms, preferably 4 to 12 carbon atoms, for the production of propylene, said process using a supported catalyst comprising at least one zeolite having form selectivity and with a Si/Al ratio in the range 50 to 1200, preferably in the range 60 to 800, and more preferably in the range 75 to 140, said zeolite being selected from within one of the following groups: MEL, MFI, NES, EUO, FER, CHA, MFS, MWW and NU-85, NU-86, NU-88 and IM-5, or a mixture of zeolites from the two groups, the process being characterized in that the feed is circulated as a cross flow with respect to the catalyst in at least one radial reactor functioning in moving bed mode, a flow of used catalyst is withdrawn continuously or discontinuously from the lower portion of the reactor, a first fraction of said used catalyst is recycled to the reactor head, the complementary fraction of the used catalyst is transferred into a regeneration zone where it undergoes at least one controlled oxidation step, and the regenerated catalyst fraction is reintroduced into the upper portion of said reactor, mixed with the first fraction of used catalyst.

DETAILED DESCRIPTION OF THE INVENTION

Thus, the invention concerns an improved moving bed catalytic oligocracking process for producing propylene from olefinic hydrocarbon cuts mainly containing 4 to 12 carbon atoms.

The feed for the moving bed catalytic oligocracking process of the invention typically contains 20% to 100% by weight, usually 25% to 60% by weight of olefins, in particular light olefins containing 4 and/or 5 carbon atoms.

Typically, the catalyst may comprise at least one zeolite having a form selectivity, said zeolite having a Si/Al ratio in the range 50 to 1200, in particular in the range 60 to 800, and preferably in the range 75 to 140.

The supported catalyst comprises at least one zeolite having form selectivity belonging to the group constituted by zeolites with one of the following structure types: MEL, MFI, NES, EUO, FER, CHA, MFS, MWW, or to the group constituted by the following zeolites: NU-85, NU-86, NU-88 and IM-5, or being constituted by a mixture of the two types of zeolites.

One advantage with said zeolites having form selectivity is that they result in better propylene/isobutene selectivity, i.e. the propylene/isobutene ratio is higher in the cracking effluents.

The zeolite or zeolites may be dispersed in a matrix based on silica, zirconia, alumina or silica-alumina, the proportion of zeolite usually being in the range 15% to 80% by weight, preferably in the range 30% to 80% by weight.

Si/Al ratios in the preferred range of 75 to 140 may be obtained at the time of manufacture of the zeolite, or by dealumination and elimination of the subsequent alumina.

In particular, it is possible to use a commercial ZSM-5 zeolite: CBV 28014 (Si/Al ratio: 140), and CBV 1502 (Si/Al ratio: 75) from Zeolyst International, Valley Forge Pa., 19482 USA, or ZSM-5 Pentasil with a Si/Al ratio of 125 from Süd Chemie (Munich, Germany).

The catalyst is used in a moving bed, preferably in the form of beads with a preferred diameter in the range 1 mm to 3 mm.

The regeneration phase typically comprises a phase for combustion of carbonaceous deposits formed on the catalyst, for example using an air/nitrogen mixture, air or air depleted in oxygen (for example by exhaust recirculation), and may optionally comprise other phases for treatment and regeneration of the catalyst.

Usually, the catalytic oligocracking unit is operated at a temperature in the range 450° C. to 620° C., preferably in the range 480° C. to 580° C., with a space velocity generally in the range 0.5 $h^{-1}$ to 6 $h^{-1}$, preferably in the range 1 to 4 $h^{-1}$.

The operating pressure is generally in the range 0.1 MPa to 0.5 MPa.

The oligocracking catalyst regeneration conditions generally employ a temperature in the range 400° C. to 650° C., the pressure usually being close to the oligocracking pressure.

Generally, the yield per pass of propylene with respect to the quantity of olefins contained in the fresh feed for the process is in the range 25% to 50% by weight.

The moving bed oligocracking process of the invention generally comprises a system for contact and mixing of the fraction of non regenerated used catalyst and of the complementary fraction of regenerated catalyst located upstream of the reaction zone.

This contact system may in some cases be a static mixer or a fluidized bed which will be described in more detail in the description below.

Finally, the flow rate of non regenerated used catalyst recycled to the head of the oligocracking reactor may be controlled from the in line measurement of the butenes content in the olefinic feed or the amount of propylene in the effluent. Other in-line measurements of a physiochemical measurement of the feed and/or the effluent may be envisaged, and do not in any way limit the scope of the invention.

In some cases, though, the operator may decide on the fraction of non regenerated used catalyst to be recycled to the head of the oligocracking reactor, for example from an analysis of the optimum fraction deduced from subsequent experiments.

The process of the invention may result in high conversion, selectivity and yield of propylene from a C2 to C12 olefinic feed, preferably C4 to C12, by dint of optimum control of the activity of the catalyst within the reactor by recycling a fraction of the used catalyst withdrawn from the reactor outlet to the inlet of the moving bed reactor.

The typical feed for the process of the invention is an olefinic feed generally derived from a FCC unit or from a steam cracking unit.

The feed for the process of the invention may also comprise C4/C5 fractions, or broader fractions deriving from chamber coking or fluidized bed coking or from a visbreaking unit or from a Fischer-Tropsch synthesis unit.

The feed may also comprise fractions of a steam cracking gasoline or FCC gasoline or from another olefinic gasoline. The term "gasoline" means a hydrocarbon cut primarily derived from at least one conversion or synthesis unit such as FCC, visbreaking, coking or a Fischer-Tropsch unit, the majority of which is constituted by hydrocarbons containing at least 5 carbon atoms and with a final boiling point of close to 220° C.

The olefinic cut constituting the feed for the process of the invention generally comprises olefins containing 2 to 12 carbon atoms, preferably 4 to 12 carbon atoms. It is preferably selected from the feeds defined above, or it may be constituted by a mixture of the feeds defined above.

It may also comprise ethylene, possibly small quantities of non fractionated propylene, hexenes and olefins containing 7 to 10 carbon atoms.

The feed also frequently comprises highly unsaturated compounds such as dienes (diolefins) containing 4 or 5 carbon atoms in particular (in particular butadiene), and small quantities of acetylenic compounds containing 2 to 10 carbon atoms. Typically, at least 80% by weight of the olefinic feed is derived directly from one or more hydrocarbon cracking units, for example units belonging to the following units: FCC, steam cracking, visbreaking, coking.

Radial reactors operating in moving bed mode with a catalyst regeneration loop are well known in the oil and petrochemicals industries, and are used in many processes, for example in processes for continuous catalytic reforming of hydrocarbons. The catalyst in these processes is in the form of approximately spherical particles in the range 1 to 3 mm in dimensions.

Typically, one or more radial reactors are used functioning in series with a common catalyst regeneration loop for the series of radial reactors. Each radial reactor of the series is supplied with used catalyst from the preceding reactor.

The term "radial reactor" means a moving bed reactor in which the feed traverses the bed along an axis substantially perpendicular to the axis of flow of the catalyst, generally from the outside of the reactor to the inside. The reaction effluents are then collected in a well or central collector.

A lift pot is used at the outlet from each reactor of the series to recover the catalyst then transfer it pneumatically, for example using a stream of nitrogen, to the next reactor or to the regeneration zone in which the catalyst is regenerated.

The regeneration phase typically comprises at least one phase for combustion of carbonaceous deposits formed on the catalyst, for example using an air/nitrogen mixture or air depleted in oxygen (for example by exhaust recirculation) or air which has preferably been dehydrated, and may optionally comprise other phases for treatment and regeneration of said catalyst.

The regenerated catalyst is then transferred pneumatically to the upper portion of the first reactor of the series, and optionally as a makeup to the other reactors of the series.

The regeneration zone may also be operated in moving bed mode, at a pressure which is generally close to the mean process pressure, and at a temperature which is generally in the range 400° C. to 650° C.

When several reactors are used in series, the catalyst may circulate as an overall counter-current or as an overall co-current with respect to the feed. Further details regarding moving bed processes may be obtained by reference to the following patents: U.S. Pat. Nos. 3,838,039, 5,336,829, 5,849,976 and EP-A1-1 195 424

More precisely, the invention concerns a process for direct conversion by catalytic (oligo) cracking of a light olefinic hydrocarbon feed comprising mainly 4 to 12 carbon atoms for the production of propylene, said process comprising direct cracking of the feed on a supported catalyst.

The supported catalyst comprises at least one zeolite having form selectivity belonging to the group constituted by zeolites with one of the following structure types: MEL, MFI, NES, EUO, FER, CHA, MFS, MWW group, or to the group constituted by the following zeolites: NU-85, NU-86, NU-88 and IM-5.

The conjunction "or" should be construed in its non exclusive sense, which means that the catalyst may in some cases be constituted by a mixture of zeolites belonging to each of the 2 groups defined above.

The feed circulates through the catalytic bed, preferably radially, at a temperature in the range 450° C. to 580° C. in at least one moving bed reactor using said catalyst.

A flow of used catalyst (i.e. containing a carbonaceous deposit generally termed coke) is withdrawn continuously or discontinuously from the lower portion of the reactor; a portion thereof is recycled directly to the inlet to said reactor, and the other portion is transferred to a regeneration zone in which the used catalyst undergoes at least one controlled oxidation step.

The regenerated catalyst (i.e. containing a reduced amount of carbonaceous deposit with respect to the used catalyst), is reintroduced directly or indirectly into the upper portion of the first reactor in the series where it is mixed with the portion that has not undergone regeneration.

A system for mixing the fraction of non regenerated used catalyst and the complementary fraction of regenerated catalyst is employed in the upper portion of the first reactor of the series.

Said system may be a static mixer for mixing the regenerated catalyst with the portion that has not undergone regeneration. The mixer is placed in the line upstream of the reactor.

The type of mixer and its length will be selected as a function of the percentage of recycled catalyst, and thus of the ratio of the flow rates of the regenerated catalyst and the non regenerated catalyst.

The ratio of the length of the mixer to the diameter of the mixer may vary from 5 to 15, and preferably from 8 to 12. The mixer may, for example, have fixed internal elements with alternating reversed pitches resulting in vortices in the solid (for example a Kenics KM static mixer).

In another configuration, the mixer may separate the flow of solid into individual streams, subsequently bringing them into contact again (for example a Sulzer SMX static mixer).

A further means for mixing the two types of solid is the use of a fluidized bed. The fluidization gas may be nitrogen, injected uniformly into the base of the fluidized bed using a distributor. The regenerated and non regenerated catalysts are brought into contact and mixed under the effect of the fluidization, which results in considerable agitation of the fluidized solid. Although the particles used in the moving bed have dimensions rendering their aptitude for fluidization low, they can be fluidized.

Mixing is generally good and the solid is not entrained from the moment in which the rate of gas fluidization is in the range 2 to 10 times the minimum rate of fluidization, and preferably between 3 and 8 times the minimum fluidization rate.

The well-mixed solid is withdrawn from the base of the fluidized bed and then feeds the first reactor of the series.

The flow rate of the directly recycled used catalyst (i.e. not regenerated) is determined so as to obtain an optimum mean activity of the catalyst mixture in terms of yield and propylene selectivity in the reactor effluent.

The respective flow rates of the regenerated catalyst and the used catalyst recycled to the inlet to the mixer located upstream of the reactor are determined as a function of in-line measurements made on the feed, for example the butenes content, or in-line measurements of the propylene yield, or in-line measurements of the conversion of C4 and propylene selectivity, or any other measurement of unit performance. It is also possible to simultaneously use measurements of the butene percentage, that of propylene, and that of propane in the effluents. By comparison with a kinetic model, the computer deduces whether the mean catalytic activity is correct or not, and if necessary modifies the flow rate of the recycled used catalyst and/or the mean catalyst circulation rate.

The respective flow rates of the regenerated catalyst and the directly recycled used catalyst are controlled via the transport gas flow rates injected into the lift pots.

Preferably, the zeolite or zeolites used in the catalyst belong to the sub group constituted by zeolites with structure type MEL, MFI and CHA, or to the sub-group of zeolites with structure type MFI. In particular, a ZSM-5 zeolite may be used. The catalyst used may also be a mixture of these different zeolites.

The process of the invention may use one or more reactors, or more reaction zones located inside the same reaction vessel.

The space velocity HSV is defined as the ratio of the mass flow rate of hydrocarbon feed to the mass of catalyst contained in each reaction zone and may, for example, be in the range 0.5 $h^{-1}$ to 6 $h^{-1}$, and preferably in the range 1 $h^{-1}$ and 4 $h^{-1}$.

Before being introduced into the moving bed oligocracking unit, the feed may undergo selective hydrogenation in a preliminary step to eliminate diolefins and other acetylenic impurities frequently present in the feed.

These various highly unsaturated compounds contribute to a certain deactivation of the oligocracking catalyst, and selective hydrogenation may increase the quantity of convertible olefins.

The effluent from the moving bed catalytic oligocracking unit typically undergoes a fractionation step usually comprising compression of gas and one or more distillation steps to separate the effluents and produce a propylene-rich C3 cut or substantially pure propylene. The distillation steps may be carried out using distillation columns comprising an internal wall to allow a reduction in operating costs and construction costs.

If the moving bed catalytic oligocracking unit of the invention is located on the same site as the steam cracking unit or a FCC unit, the effluents from said moving bed oligocracking unit may be combined with that of the steam cracking or FCC units for common fractionation.

The effluents from the moving bed catalytic oligocracking unit may also be treated separately from the steam cracking or FCC units.

Figure 1:
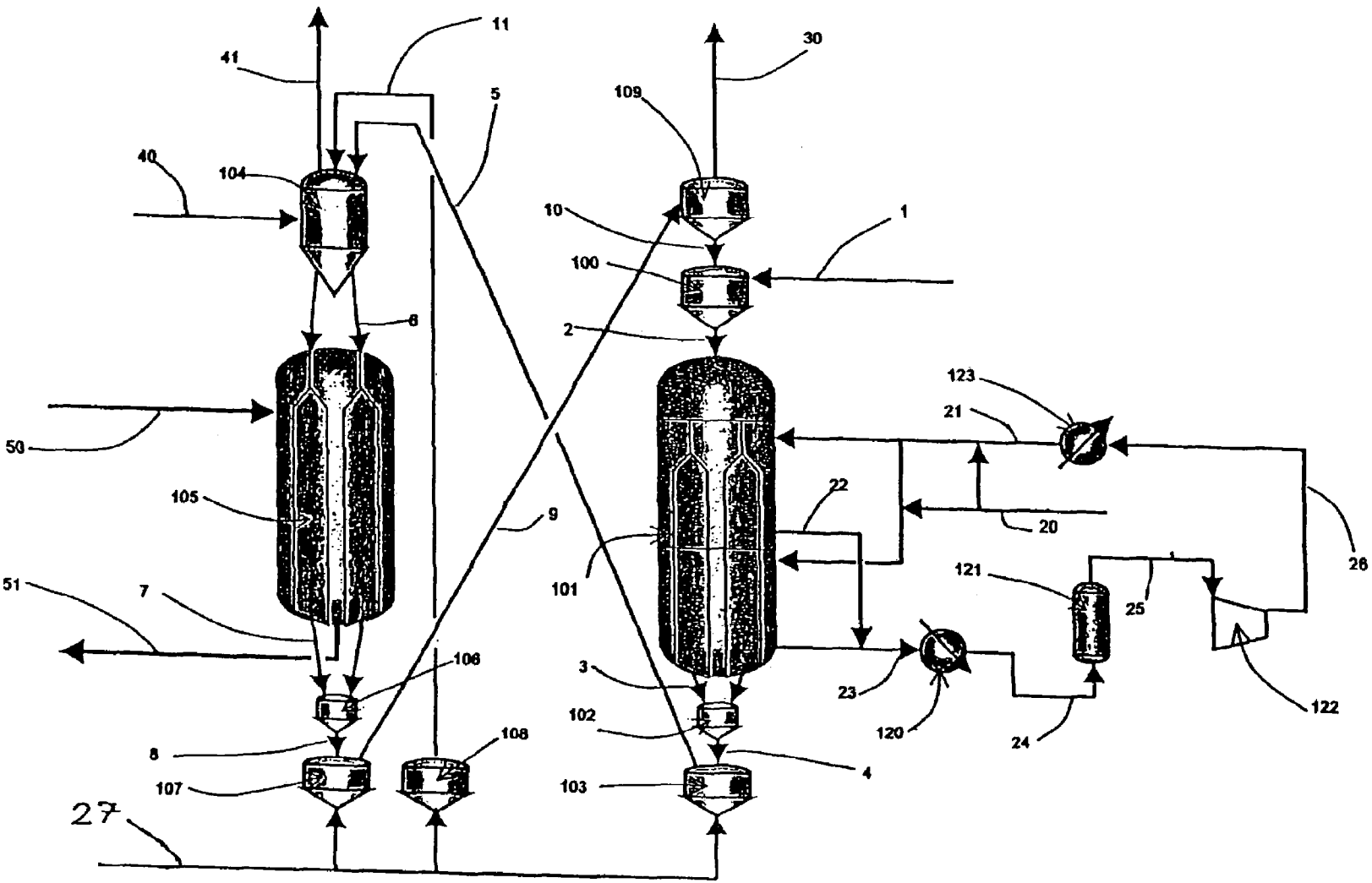
FIG. 1 is a schematic diagram illustrating an embodiment of the invention.

The invention will be better understood from the description of FIG. 1.

A feed (50) is introduced in the vapour form into a moving bed reactor (105).

The feed traverses the catalyst bed radially and reacts, producing an effluent (51). The effluent (51) is collected at the centre of the reactor then sent to the subsequent treatments.

A makeup of fresh catalyst (1) is introduced into the lower hopper (100) of the regenerator where it is mixed with used catalyst (10) from the upper hopper (109) of the regenerator. The catalyst mixture (2) is fed semi-continuously into a first moving bed radial regenerator zone (101) by gravity flow where it undergoes combustion in the presence of a gas (21) enriched in air (20). The combustion gas (22) is withdrawn and sent to the exchanger (120). The catalyst is then calcined in a second zone in the presence of a gas (21) enriched with air (22). The combustion gas (23) is also sent to the exchanger (120) for cooling to an appropriate temperature for dehydration in the dryer (121). The dried gas (25) is then introduced into a compressor (122). The compressed combustion gas (26) is heated in the furnace (123) before being mixed with air (20) then reintroduced into the regenerator.

The regenerated catalyst (3) passes into a hopper (102) then into a lift pot (103) for pneumatic transport to the upper hopper of the reactor (104) using transport nitrogen (27).

In the upper hopper (104) of the reactor, the regenerated catalyst (5) is mixed with the used catalyst (11) from the secondary lift pot of the reactor (108).

A flush (40) can evacuate the fines created during transport to a particle filter (41).

The mixture (6) of a portion of regenerated catalyst (5) and a portion of used catalyst (11) is introduced into the radial moving bed reactor (105) where it is brought into contact with the feed (50).

The catalyst flows under gravity in the reactor and is recovered from the bottom in a hopper (106). A portion of the catalyst (9) is sent pneumatically towards the regeneration step using the primary lift pot (107) of the reactor, while a fraction of the used catalyst (11) is sent directly to the reactor head by means of the secondary lift pot (108) of the reactor. The lift pot (108) is also supplied with used catalyst via the hopper (106) via a line which is not shown. The two lift pots of the reactor are supplied with drive gas (nitrogen) via the line (27).

Figure 2:
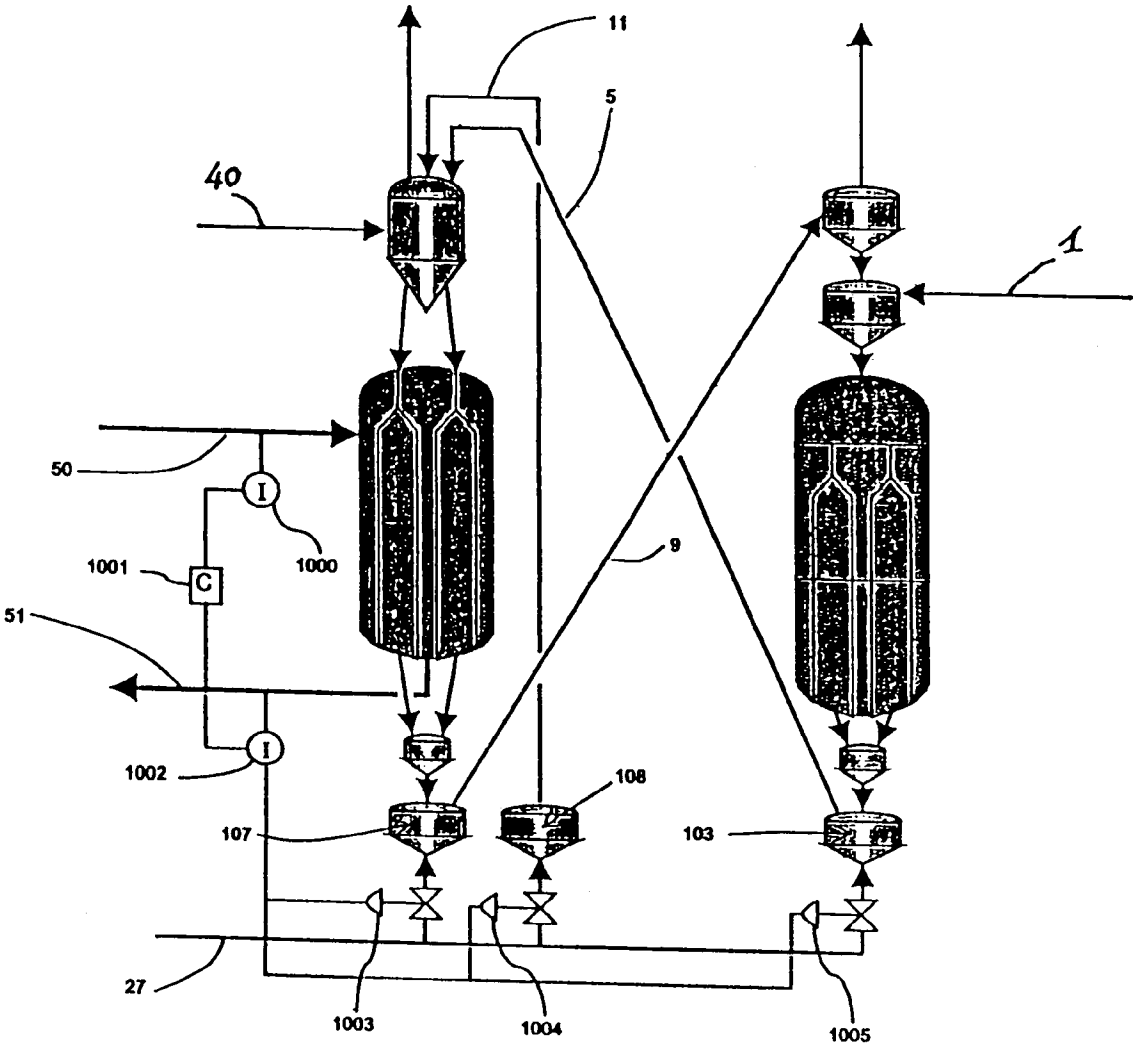
FIG. 2 is a schematic diagram illustrating a means for controlling the respective flow of the used and regenerated catalyst.

FIG. 2 shows a means for controlling the respective flows of the used and regenerated catalyst.

Measurement means (1000) and (1002) are respectively disposed on the feed (50) and effluent (51). These means can, for example, measure the butenes and/or propylene and/or propane content of the feed and effluent. A computer (1001) can calculate the propylene conversions and selectivities. The information from the computer, which includes a kinetic model, are sent to valves controlling the flow rate of the transport gas (1003), (1004) and (1005) to adjust the flow rates of the recycled used catalyst (11) from the lift pot (108), the flow rate of used catalyst (9) from the lift pot (107) in the direction of the regeneration zone, and the flow rate of regenerated catalyst (5) from the lift pot (103) respectively.

EXAMPLES

The following examples illustrate the importance of the invention in terms of propylene selectivity. Examples 1 (prior art) and 2 (in accordance with the invention) used a MFI zeolite with a Si/Al ratio of 75, and Examples 3 (prior art) and 4 (in accordance with the invention) used a MFI zeolite with a Si/Al ratio of 140.

Example 1

Prior Art

In this prior art example, the feed to be treated was constituted by 100% isobutene.

The feed was injected into a reactor functioning in moving bed mode.

The catalyst used was a CBV1502 containing 80% MFI type zeolite having a Si/Al ratio of 75. The catalyst was regenerated in a regeneration zone functioning at a temperature of 823K and at a pressure of 0.10 MPa.

The cycle time for the catalyst was 48 hours. The reaction was carried out at a temperature of 853K and at a total pressure of 0.12 MPa. The liquid space velocity was 4.5 $h^{-1}$.

The compositions obtained at the outlet from the reactors are shown in Table 1.

TABLE 1

Composition at outlet from moving bed with no used catalyst recycle.

| Compound | Composition (wt %) |
|---|---|
| Methane | 1.92 |
| Ethylene | 15.30 |
| Ethane | 1.00 |
| Propylene | 24.95 |
| Propane | 5.22 |
| Isobutane | 4.02 |
| Isobutene | 5.21 |
| 1-butene | 2.60 |
| Butane | 2.50 |
| Trans-2-butene | 3.19 |
| Cis-2-butene | 2.40 |
| 3-methyl-1-butene | 0.14 |
| Isopentane | 0.69 |
| 1-pentene | 0.23 |
| 2-methyl-1-butene | 0.71 |

TABLE 1-continued

Composition at outlet from moving bed with no used catalyst recycle.

| Compound | Composition (wt %) |
|---|---|
| Pentane | 0.24 |
| Trans-2-pentene | 0.58 |
| Cis-2-pentene | 0.32 |
| 2-methyl-2-butene | 1.29 |
| Trans-1,3-pentadiene | 0.03 |
| Cis-1,3-pentadiene | 0.05 |
| Cyclopentene | 0.14 |
| Cyclopentane | 0.48 |
| Others (C6+) | 26.78 |
| Total | 100.00 |

The performance of the unit in terms of selectivity and yield were as follows:

| | |
|---|---|
| Ethylene selectivity | 19.10% |
| Propylene selectivity | 31.15% |
| Ethylene yield | 15.30% |
| Propylene yield | 24.95% |

Example 2

In Accordance with the Invention

In this example, the feed to be treated and the catalyst were the same as those used in Example 1 (prior art). 49% by weight of the flow of used catalyst was directly recycled to the head of the moving bed reactor mixed with a complementary 51% of regenerated catalyst. The catalyst was regenerated under the same conditions as those in Example 1 (prior art).

The compositions obtained at the outlet from the reactors are shown in Table 2.

TABLE 2

Composition at outlet from moving bed with used catalyst recycle.

| Compound | Composition (wt %) |
|---|---|
| Methane | 0.73 |
| Ethylene | 9.61 |
| Ethane | 0.36 |
| Propylene | 28.97 |
| Propane | 2.08 |
| Isobutane | 2.15 |
| Isobutene | 12.98 |
| 1-butene | 6.38 |
| Butane | 1.80 |
| Trans-2-butene | 7.90 |
| Cis-2-butene | 5.99 |
| 3-methyl-1-butene | 0.29 |
| Isopentane | 0.34 |
| 1-pentene | 0.48 |
| 2-methyl-1-butene | 1.44 |
| Pentane | 0.16 |
| Trans-2-pentene | 1.19 |
| Cis-2-pentene | 0.67 |
| 2-methyl-2-butene | 2.59 |
| Trans-1,3-pentadiene | 0.06 |
| Cis-1,3-pentadiene | 0.06 |
| Cyclopentene | 0.22 |
| Cyclopentane | 0.40 |
| Others (C6+) | 13.16 |
| Total | 100 |

The performance of the unit in terms of selectivity and yield were as follows:

| | |
|---|---|
| Ethylene selectivity | 15.30% |
| Propylene selectivity | 46.13% |
| Ethylene yield | 9.61% |
| Propylene yield | 28.97% |

It can be seen that recycling a fraction of the used catalyst increased the propylene selectivity by 15 percentage points and increases the propylene yield by 4 percentage points.

Example 3

Prior Art

In this prior art example, the feed to be treated was constituted by 100% isobutene.

The feed was injected into a reactor functioning in moving bed mode.

The catalyst used was a CBV28014 containing 30% of MFI type zeolite having a Si/Al ratio of 140. The catalyst was regenerated at a temperature of 823K and at a pressure of 0.10 MPa.

The cycle time for the catalyst was 48 hours. The reaction was carried out at a temperature of 783K and at a total pressure of 0.12 MPa. The liquid space velocity was 1.7 $h^{-1}$.

The compositions obtained at the outlet from the reactors are shown in Table 3.

TABLE 3

Composition at outlet from moving bed with no used catalyst recycle.

| Compound | Composition (wt %) |
|---|---|
| Methane | 0.10 |
| Ethylene | 3.63 |
| Ethane | 0.08 |
| Propylene | 23.61 |
| Propane | 1.46 |
| Isobutane | 2.19 |
| Isobutene | 14.08 |
| 1-butene | 6.71 |
| Butane | 1.51 |
| Trans-2-butene | 9.97 |
| Cis-2-butene | 7.30 |
| 3-methyl-1-butene | 0.47 |
| Isopentane | 0.67 |
| 1-pentene | 0.70 |
| 2-methyl-1-butene | 2.72 |
| Pentane | 0.29 |
| Trans-2-pentene | 2.06 |
| Cis-2-pentene | 1.10 |
| 2-methyl-2-butene | 5.62 |
| Trans-1,3-pentadiene | 0.03 |
| Cis-1,3-pentadiene | 0.02 |
| Cyclopentene | 0.22 |
| Cyclopentane | 0.33 |
| Others (C6+) | 15.12 |
| Total | 100.00 |

The performance of the unit in terms of selectivity and yield were as follows:

| | |
|---|---|
| Ethylene selectivity | 6.24% |
| Propylene selectivity | 40.55% |
| Ethylene yield | 3.63% |
| Propylene yield | 23.61% |

Example 4

In Accordance with the Invention

In this example, the feed to be treated and the catalyst were the same as those used in Example 3 (prior art). The catalyst was regenerated under the same conditions as those used in Example 3.

25% by weight of the flow of the used catalyst was recycled directly to the head of the moving bed reactor mixed with 75% of regenerated catalyst.

The compositions obtained at the outlet from the reactors are shown in Table 4.

TABLE 4

Composition at outlet from moving bed with used catalyst recycle.

| Compound | Composition (wt %) |
|---|---|
| Methane | 0.09 |
| Ethylene | 3.25 |
| Ethane | 0.07 |
| Propylene | 23.29 |
| Propane | 1.24 |
| Isobutane | 1.95 |
| Isobutene | 14.86 |
| 1-butene | 7.21 |
| Butane | 1.37 |
| Trans-2-butene | 10.72 |
| Cis-2-butene | 7.85 |
| 3-methyl-1-butene | 0.49 |
| Isopentane | 0.59 |
| 1-pentene | 0.72 |
| 2-methyl-1-butene | 2.80 |
| Pentane | 0.26 |
| Trans-2-pentene | 2.12 |
| Cis-2-pentene | 1.13 |
| 2-methyl-2-butene | 5.77 |
| Trans-1,3-pentadiene | 0.03 |
| Cis-1,3-pentadiene | 0.02 |
| Cyclopentene | 0.21 |
| Cyclopentane | 0.31 |
| Others (C6+) | 13.67 |
| Total | 100 |

The performance of the unit in terms of selectivity and yield were as follows:

| | |
|---|---|
| Ethylene selectivity | 5.80% |
| Propylene selectivity | 41.56% |
| Ethylene yield | 3.25% |
| Propylene yield | 23.29% |

It can be seen that recycling a fraction of the used catalyst increased the propylene selectivity by 1 percentage point for a practically constant propylene yield.

The invention claimed is:

1. A moving bed process for catalytic oligocracking of a light olefinic hydrocarbon feed comprising hydrocarbons containing 2 to 12 carbon atoms, for the production of propylene, said process comprising contacting said feed with a supported catalyst having a particle size of 0.5 to 5 mm comprising at least one zeolite having form selectivity and with a Si/Al ratio in the range 50 to 1200, said zeolite being selected from one of the two following groups: one is the group formed by MEL, MFI, NES, EUO, FER, CHA, MFS and MWW and the other is the group formed by NU-85, NU-86, NU-88 and IM-5, or a mixture of zeolites from the two groups, the process being characterized in that the feed is circulated as a cross flow with respect to the catalyst in at least one vertically disposed radial reactor having a head portion and a lower portion functioning in moving bed mode, a flow of used catalyst is withdrawn continuously or discontinuously from the lower portion of the reactor, a first fraction of the withdrawn used catalyst is recycled to the reactor head portion, the complementary fraction of the used catalyst is transferred into a regeneration zone where it undergoes at least one controlled oxidation step, and the regenerated catalyst fraction is reintroduced into the head portion of said reactor in admixture with the first fraction of used catalyst, wherein the recycling of the used catalyst to the reactor head portion results in reducing the catalytic activity gradient between the head and lower portion of the reactor.

2. A moving bed oligocracking process according to claim 1, in which the regeneration phase comprises at least one phase for combustion of carbonaceous deposits formed on the catalyst using an air/nitrogen mixture, air or air depleted in oxygen at a temperature in the range 400° C. to 650° C.

3. A moving bed oligocracking process according to claim 1, in which the reaction temperature is in the range 450° C. to 620° C.

4. A moving bed oligocracking process according to claim 1, in which the space velocity defined as the ratio of the mass flow rate of the feed to the mass of catalyst is in the range 0.5 $h^{-1}$ to 6 $h^{-1}$.

5. A moving bed oligocracking process according to claim 1, in which the operating pressure is in the range 0.1 MPa to 0.5 MPa.

6. A moving bed oligocracking process according to claim 1, in which the yield of propylene per pass with respect to the quantity of olefins contained in the fresh feed for the process is in the range 25% to 50% by weight.

7. A moving bed oligocracking process according to claim 1, in which the fraction of non regenerated used catalyst and the complementary fraction of regenerated catalyst are mixed in a static mixer located upstream of the head portion of the at least one radial reactor.

8. A moving bed oligocracking process according to claim 1, in which the fraction of non regenerated used catalyst and the complementary fraction of regenerated catalyst are mixed in a fluidized bed located upstream of the reaction zone.

9. A moving bed oligocracking process according to claim 1, in which the flow rate of the non regenerated used catalyst recycled to the head of the oligocracking reactor is controlled in response to the in-line measurement of the butene content in the olefinic feed.

10. A moving bed oligocracking process according to claim 1, in which the flow rate of the non regenerated used catalyst recycled to the head of the oligocracking reactor is controlled in response to the in-line measurement of the propylene content in the effluent.

11. A moving bed oligocracking process according to claim 7, in which the static mixer upstream of the reactor head has a length to diameter ratio in the range of 5 to 15.

12. A moving bed oligocracking process according to claim 8, in which the fluidized bed used at the reactor head is operated with a fluidization rate in the range of 2 to 10 times the minimum fluidization rate.

13. A process according to claim 1, wherein the hydrocarbon feed comprises hydrocarbons containing 4 to 12 carbon atoms.

14. A moving bed oligocracking process according to claim 7, in which the flow rate of the non regenerated used catalyst recycled to the head of the oligocracking reactor is controlled in response to the in-line measurement of the butene content in the olefinic feed.

15. A moving bed oligocracking process according to claim 8, in which the flow rate of the non regenerated used catalyst recycled to the head of the oligocracking reactor is controlled in response to the in-line measurement of the butene content in the olefinic feed.

16. A moving bed oligocracking process according to claim 7, in which the flow rate of the non regenerated used catalyst recycled to the head of the oligocracking reactor is controlled in response to the in-line measurement of the propylene content in the effluent.

17. A moving bed oligocracking process according to claim 8, in which the flow rate of the non regenerated used catalyst recycled to the head of the oligocracking reactor is controlled in response to the in-line measurement of the propylene content in the effluent.

18. A moving bed oligocracking process according to claim 1, wherein said at least one zeolite is an MFI zeolite having an Si/Al ratio of 75-140.

19. A moving bed oligocracking process according to claim 1, wherein said at least one zeolite is an MFI zeolite having an Si/Al ratio of 75.

20. A moving bed oligocracking process according to claim 1, wherein said particle size is about 1-3 mm and the mean flow rate of the moving bed is less than 0.1 m per minute.

* * * * *